US005543596A

United States Patent [19]

Jones et al.

[11] Patent Number: 5,543,596

[45] Date of Patent: Aug. 6, 1996

[54] HIGHWAY CROSSING GATE MECHANISM CIRCUIT CONTACT

[75] Inventors: Richard S. Jones, Swansea; William H. Hodges, Jr., South Congaree; Paul M. Evans, Columbia, all of S.C.

[73] Assignee: Union Switch & Signal Inc., Pittsburgh, Pa.

[21] Appl. No.: 291,094

[22] Filed: Aug. 16, 1994

[51] Int. Cl.[6] ..... H01H 3/42

[52] U.S. Cl. ..... 200/573; 200/558

[58] Field of Search ..... 200/568, 569, 200/564, 47, 573, 574; 74/569, 10.29, 10.35, 10.37, 10.6; 49/13, 49

[56] References Cited

U.S. PATENT DOCUMENTS 2,567,735 9/1951 Scott ..... 74/569

*Primary Examiner*—David J. Walczak
*Attorney, Agent, or Firm*—Buchanan Ingersoll

[57] ABSTRACT

A rotary switch operated by a cam having a lobe is disclosed. The cam is attached to a mechanism for rotation about the axis of the cam. A first switch contact member is positioned adjacent said cam and selectively makes electrical contact with a second switch contact member. The bracket attached to the first switch contact member contains a roller positioned adjacent to the cam for rotatably engaging the cam as the cam rotates. The roller is positioned with the bracket portion of the first contact such that the axis of the roller is movable from a first position to a second position as the switch changes from an open to closed or from a closed to open position. The bracket may contain an elongated slot which permits the axle of the roller to move within the slot as the switch changes modes. The slot preferably extends linearly and at an angle less than 45 degrees from a tangent line to the surface of said lobe adjacent the slope between said cam and said lobe. In preferred embodiments, 15 degree angles to the tangent are particularly advantageous. The switch is preferably operated in the main shaft in a highway crossing mechanism and is preferably used in the motor control circuit to drive the crossing arm upward.

9 Claims, 5 Drawing Sheets

HIGHWAY CROSSING GATE MECHANISM CIRCUIT CONTACT

BACKGROUND OF THE INVENTION

Where railway tracks or other priority traffic cross a highway or pedestrian right of way it is often desired to afford protection by a mechanism which alarms and displays the impending crossing of the priority vehicle, such as a train. Grade crossing mechanisms often include a gate mechanism in which an arm is lowered prior to the train entering the highway crossing to signal motorists to stop. Similar crossing arms can also be used to signal at pedestrian crossings. Because of the nature of these mechanisms it is often desirable that the crossing arm be held in its upward position, and should power or control be lost, gravity will bring the arm down to a horizontal or blocking position. To balance the weight of the extended arm, counter weights are often used. In applications where the arms are extensive, the counter balance can become quite heavy. To raise the arms the highway crossing mechanism utilizes a motor, usually acting through a gear train to drive the crossing arm to a vertical or up position. To maintain high accuracy, avoid backlash in the gear train, and maintain high reliability, the position of the crossing arm is sensed by cam switches which act upon cams attached directly to the output shaft which drives the crossing arm.

One of the principle functions of the circuit controller, and the cam operated switches in particular, is to control the "on" and "off" operation of the current applied to the drive motor during the drive "up" mode. The point at which this set of contacts must turn the motor off is also the point at which the motor is quite often under its heaviest load. Because the motor, which is usually a D.C. motor, is operating at its maximum current at this time, the cam operated switch is interrupting the maximum motor current flowing through the contacts. Such operation can result in severe burning or erosion of contacts. In applications where D.C. motors are used, the current interruption can be difficult due to the inductive nature of the motor armature. For these reasons it would be desirable to have a contact which opens very fast. However, because the output shaft is moving at a very slow speed, often less than two revolutions per minute, it is inherently difficult to open the contacts quickly on a cam operating directly from the slow speed output shaft.

The cam operated switches also sense the position of the arm to institute the stop positions for both the horizontal and the vertical crossing gate arm positions. Therefore it is desirable to have the cam accurately sense such position when turning the motor current off, such that a motor mounted brake can be set on the motor shaft to hold the crossing arm in the full-up position. Highway grade crossing arms can be up to forty-five feet long, and are often made of hollow aluminum or fiberglass. These crossing arm mechanisms are subject to vibration or oscillation when the arm mechanism comes to a stop. This vibration or oscillation in the crossing arm can cause the cam switch to be momentarily driven backwards over the shut-off point, and thereby reenergize the drive-up motor. Such oscillations around the turn-off points are highly undesirable as they can cause mis-positioning of the arm, or damage to portions of the mechanism. Therefore it is desirable to have a switch which senses the position of the arm to turn off the drive motor very accurately, but not be over sensitive to oscillations or slight roll backs in the drive mechanism after the power has initially been interrupted.

Cam operated limit switches are well-known and may include devices which have a contact mounted directly on a cam such that the lobe engages the switch contact to move it from a first to a second position. The speed with which the contact changes position can be controlled somewhat by the slope between the lobe area and the inner radius of the cam. Such profiling is limited to the mechanical ability of the contact engaging the slope area and the rotational speed of the cam. It is also known to use a contact which rides on a cam wherein the contact has a shoe portion which engages the lobe and cam. Respective profiling between the slope areas on the lobe and the shoe can also be used to control the opening profile of the switch. If it is desired to open the contact very quickly, a steep profile on the slope area between the cam lobe and the inner radius of the cam is often desirable. However, because the cam will usually operate in a bi-directional rotational mode, it will usually be necessary that the switch contact also must ride upon or follow the slope area during reverse operation. If the steepness of the slope becomes too great, the contact may not reliably ride upward during reverse rotation. In some prior art cam operated switches it has been known to use a roller which is free to rotate about a fixed axis on the switch member. The roller then engages the cam and the lobe and can roll both up and down the slope areas between the lobe and the inner radius of the cam. The use of the roller greatly reduces the friction between the switch contact and the cam member. However, restrictions still apply as to the steepness of the slope and the amount of control that can be provided for quick opening on slow moving shafts.

SUMMARY OF THE INVENTION

The invention provides for a rotary cam operated switch which rapidly moves from one position to another during a very short rotational movement of the cam. A roller rides on the cam and is attached to a movable contact. The roller however is attached to the movable contact in such a way that the axis of rotation of the roller is slidable between two positions. The axis of rotation of the roller can translate between these two parallel axes. This is accomplished in some embodiments by using a linear slot in a bracket mounted on the movable contact. As the roller rides off the edge of the lobe onto a slope of the cam it is forced from a first position to a second position within the bracket. At the second position the switch contacts are clearly made or broken. This results in a snap action to the switch operation. The switch cascades from one position to the other as the roller reaches the slope area.

In addition because a very slight rotation of the shaft results in such a large movement between the contacts, a slight reversal of the cam after having reached the cascade position does not result in a return to the earlier switch position. As a result, the switch does not chatter or arc back and forth when it is stopped at the instant of switch position change.

DESCRIPTION OF SOME EMBODIMENTS

Figure 1:
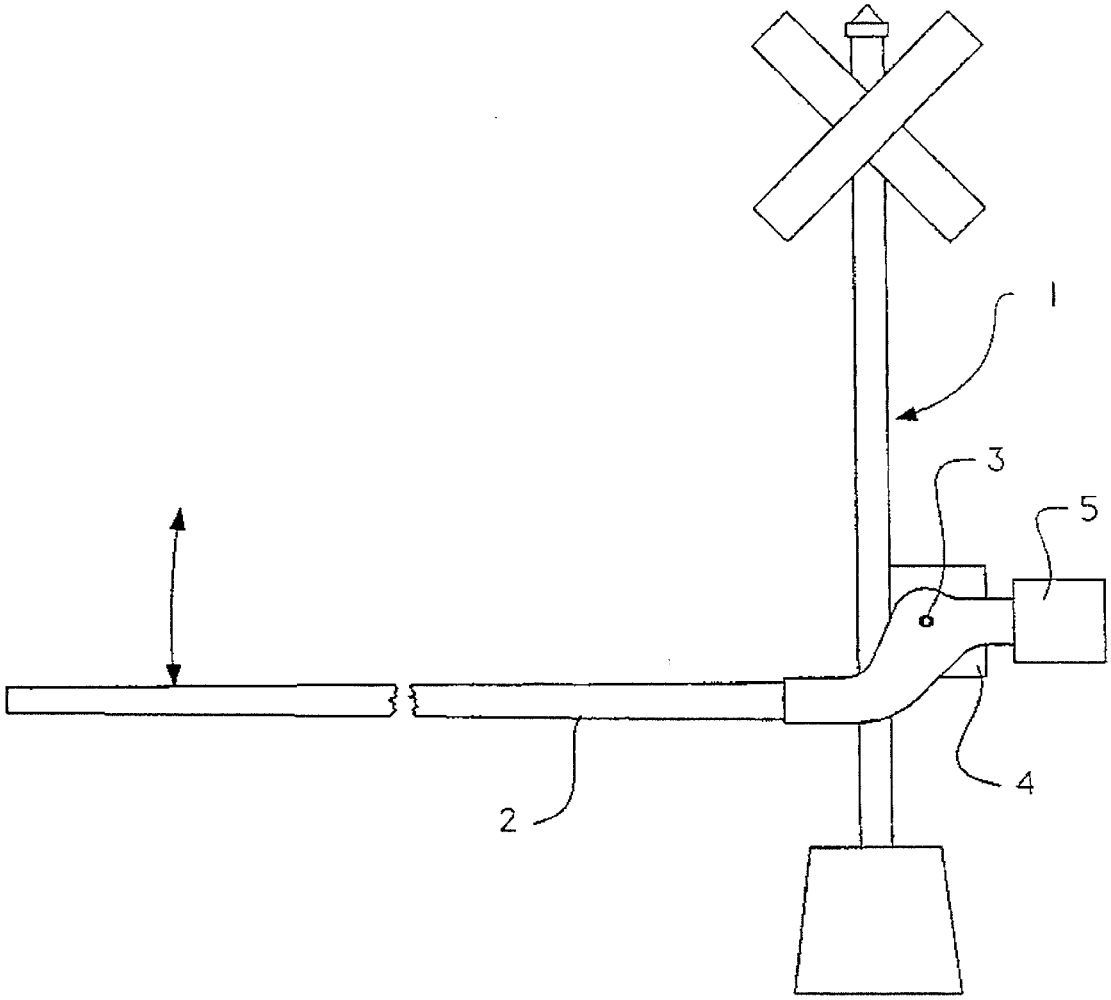
FIG. 1 shows a highway crossing gate unit for signaling automobile or pedestrian traffic to the approach of a rail vehicle.

A railway crossing arm is used to signal that a rail vehicle is approaching a highway grade crossing. FIG. 1 shows a railway grade crossing mechanism 1 which has a crossing arm 2. The crossing arm 2 is attached to a support bracket which is rotatably driven about a pivot shaft 3. Counter weights 5 may be attached to the back of the support bracket to offset some of the weight of the arm 2. However, it is normal operation to maintain the balance such that without electrical power, gravity will cause the arm 2 to settle to its horizontal or gate down position. Control housing 4 is usually mounted on the crossing mast and is used to provide electrical control and the power mechanism for raising and lowering the control arm.

Figure 2:
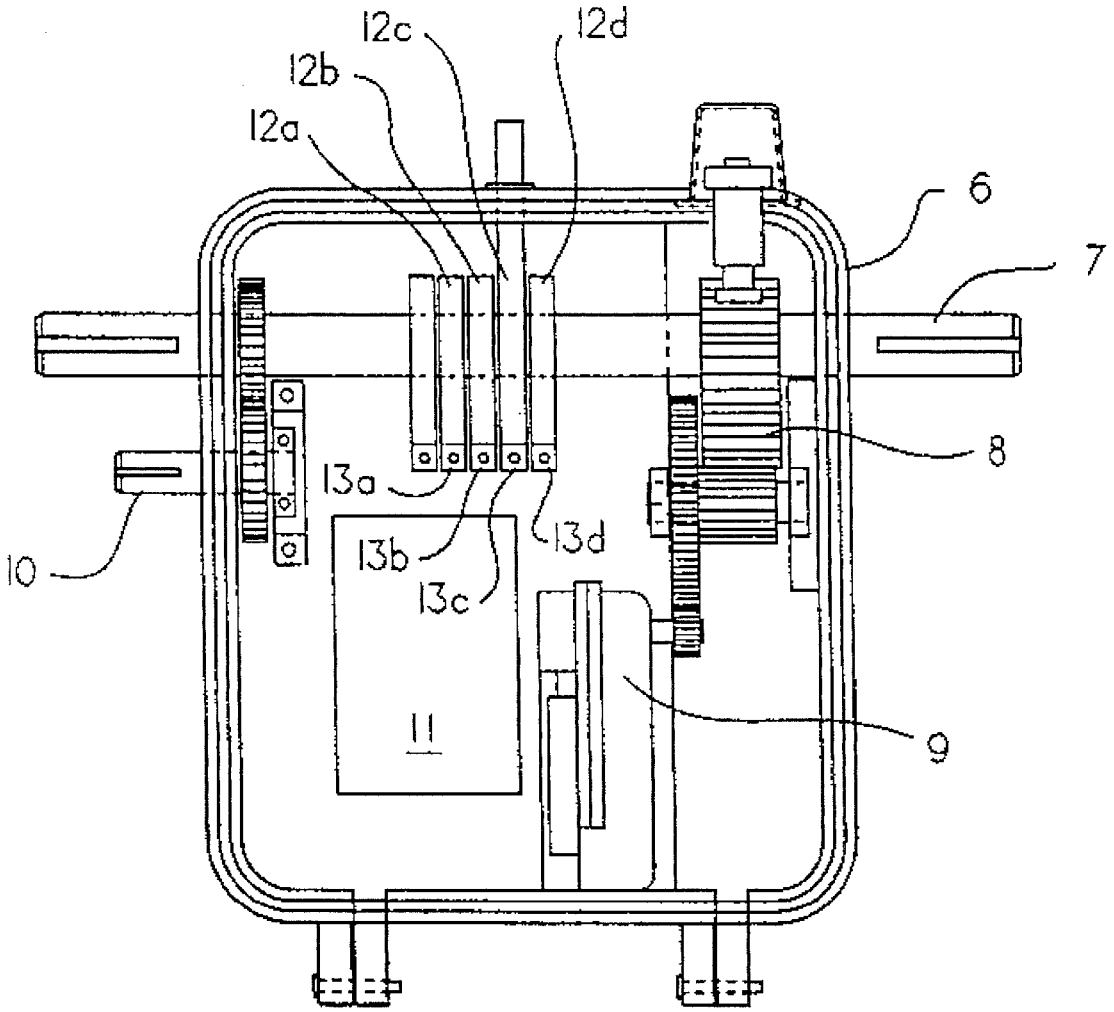
FIG. 2 is a presentation of a highway crossing gate mechanism control box showing the output shaft and cam switches.

FIG. 2 shows the housing 6 which includes a main gate arm output shaft 7 and a supplemental shaft 10. Supplemental shaft 10 may be used for a pedestrian gate where it is desirable to have the same mechanism act as a grade crossing for automobiles and an adjacent pedestrian walkway. Pedestrian shaft 10 is driven through appropriate gearing from the main shaft 7. Shaft 7 is powered by a gear motor drive 9 through additional reduction gears 8. An electrical control 11 may include relays and other components to sense the presence of a train signal and appropriately activate the crossing mechanism. Drive motor 9 may have a double extended shaft and have a shaft brake mounted on one side opposite the geared output. As such the brake can be used to maintain the position of the cross arm in the vertical or up mode. Cams 12*a*, 12*b*, 12*c*, 12*d* are attached directly to the output shaft 7. These cams may be of split design and made of a non-conducting material such that an electrical contact may ride directly upon them. Use of split cams allows the cams to be adjusted angularly with regard to the output shaft 7 and permits easy installation and replacement of cams after the assembly has been mounted in the housing 6. Cam switches 13*a*, 13*b*, 13*c*, 13*d* are mounted within the housing 7 and are positioned such that they have a switch element which rides on the cam to sense the angular position of the cam as an indication of the position of the crossing arm. While the embodiment in FIG. 2 shows four cams and four respective switches it is understood that the invention contemplates less switches or more switches depending upon the specific circuitry which may be used in any given crossing situation. The movable roller cam operated switch of this invention may be used on one or more of the cams 12*a* through 12*d*. However, it will be especially desirable to use embodiments of the invention on the cam and associated cam switch which operates the motor 9 in the drive-up mode.

Figure 3A:
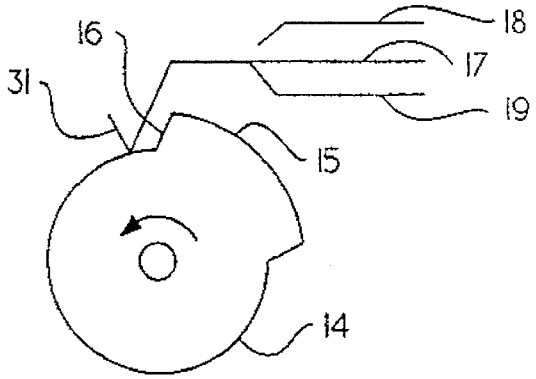
Fig.3a. Prior Art
FIGS. 3*a*, 3*b*, 3*c* and 3*d* are four diagrammatic representations of prior art cam operated switches.

FIG. 3*a*, 3*b*, 3*c* and 3*d* show four prior art cam operated switch designs. In FIG. 3*a* a movable contact 17 is positioned intermediate an upper contact 18 and a lower contact 19. The movable contact 17 has a portion 31 which is shaped as a "V" which directly rides upon the cam 14. As shown, cam 14 has a lower or inner radius and an outer radius or lobe 15. The area between the inner radius and the upper surface of the lobe can be referred to as the slope area, 16. If cam 14 is rotated in a counterclockwise direction the V-shaped portion 31 is caused to move up the slope 16 to the top surface of the lobe 15 and thereby open the connection with contact 19 and make the connection with contact 18. As cam 14 is rotated in a clockwise direction as shown, the V-shaped portion 31 of movable contact 17 would move down the slope 16 to its present position where movable contact 17 and lower contact 19 are in electrical connection. The relative shape of the V portion 31 and the slope 16 can be used to somewhat: control the opening of contacts 17 and 18. However, the opening of the contacts is highly dependent upon the speed of rotation of the cam 14. At slow speeds the contacts 18 and 17 may be subject to chattering and if the direction of rotation is changed ever so slightly the contact between 17 and 18 can be easily re-established in the area where the switch contacts parted.

Figure 3B:
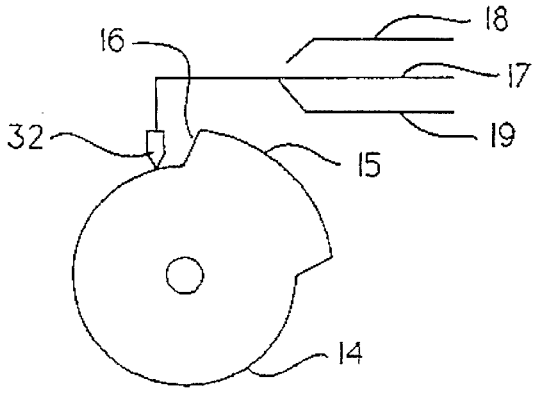
Fig.3b. Prior Art

FIG. 3*b* shows a prior art cam operated switch similar to that shown in FIG. 3*a* in which a shoe 32 is attached to the movable contact 17. This arrangement operates similar to that described with regard to that shown in FIG. 3*a*. The profile of the shoe 32 and the profile of the slope 16 can be used to control the respective opening and closing of contacts 17, 18, and 19. Again, however, the speed of the contacts opening is highly dependent upon the rotational speed of the cam 14. FIGS. 3*a* and 3*b* showed physical contact between the movable switch contact 17 and the cam 14 which may have some frictional components.

Figure 3C:
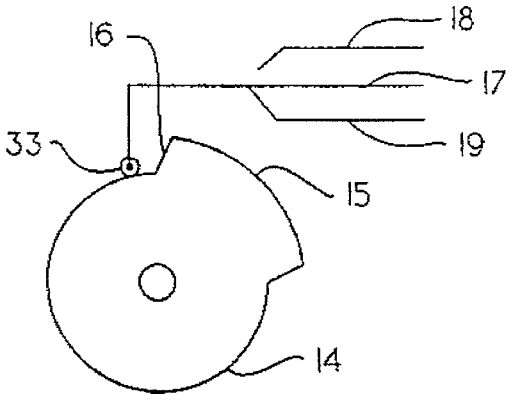
Fig.3c. Prior Art

FIG. 3*c* shows a prior art device in which a roller 33 is rotatably mounted on movable contact 17. As such, the roller is caused to move vertically as it traverses slope area 16 of FIG. 3*c*. While the friction between roller 33 and cam 14 is improved over the designs of FIGS. 3*a* and 3*b*, the speed of contact operation is still dependent upon the slope area 16 and the rotational speed of cam 14. As can be seen, roller 33, while it is free to rotate, the axis of such roller is generally fixed to the movable contact 17.

Figure 3D:
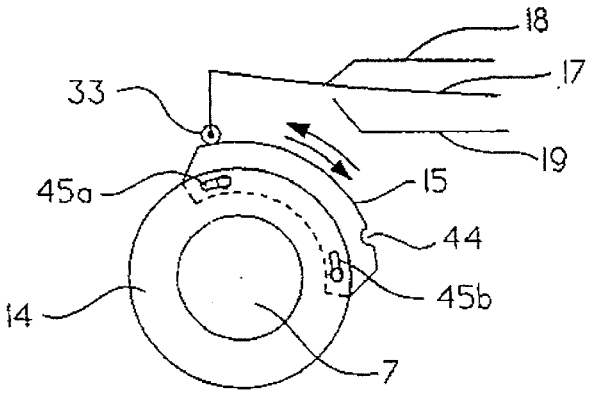
Fig.3d. Prior Art

FIG. 3*d* shows an embodiment having a cam 14 about a main shaft 7. A lobe 15 is attached to the cam in two slotted areas 45*a* and 45*b*. This permits the lobe 15 to slide back and forth at a fixed radius about the main shaft and the cam 14. In fact the cam may be formed of two metal side plates with a plastic interior. In this form the movement of the lobe 15 creates a hysteresis effect which can reduce vacillation of the contact around the stopping point, such as occurs in the gate arm. A slight indentation in the lobe 15 helps to reset the lobe on the cam 14 when the roller 33 engages the indentation 44 when the cam 14 is rotated. Some of the disadvantages of this device are that the lobe 15 may be large and difficult to move both by the roller 30 in a fast action mode and in resetting through use of the indent 44. Because of the surface area involved, the cam is subject to sticking due to excessive surface friction.

Figure 4A:
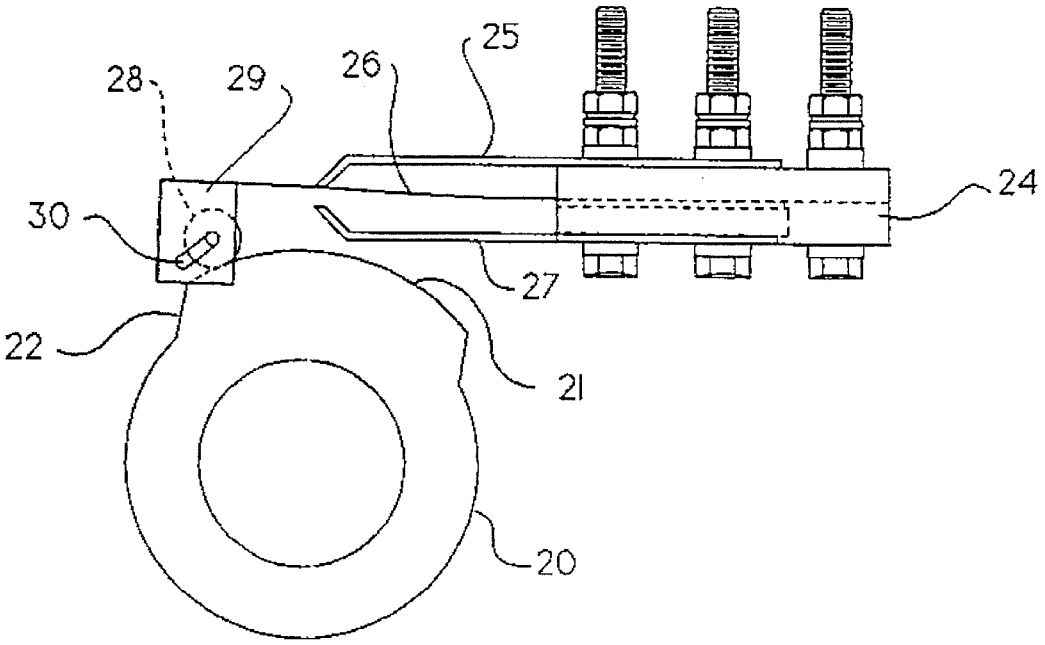
FIG. 4*a* shows an embodiment of the invention with the roller on the lobe or high point of the cam.

One present embodiment of the invention is shown in FIG. 4*a*, which has upper contact 25, a movable contact 26, and a lower contact 27. Contacts 25 through 27 are supported in a contact block 24, which has threaded terminals for each of the respective contacts. As shown, the movable contact 26 can be in the highway crossing motor control circuit such that connection between contacts 25 and 26 cause the motor to be excited and rotate in a direction to pull the highway crossing arm in an upward direction. Cam 20 is then set on the highway crossing mechanism output shaft such that the position on lobe 21 at slope area 22 represents the arm full-up position. While roller 28 is on the lobe 21 of cam 20 the drive motor of the highway crossing mechanism is actuated so as to work through the respective gearing and rotate the shaft clockwise through the center of cam 20 to power the arm upward. On the end of movable contact 26 is a roller bearing support bracket 29 which includes a slot 30. Roller 28 has extending from each side an axle portion which rides in slot 30. The bracket and roller is also shown in FIG. 5.

Figure 4B:
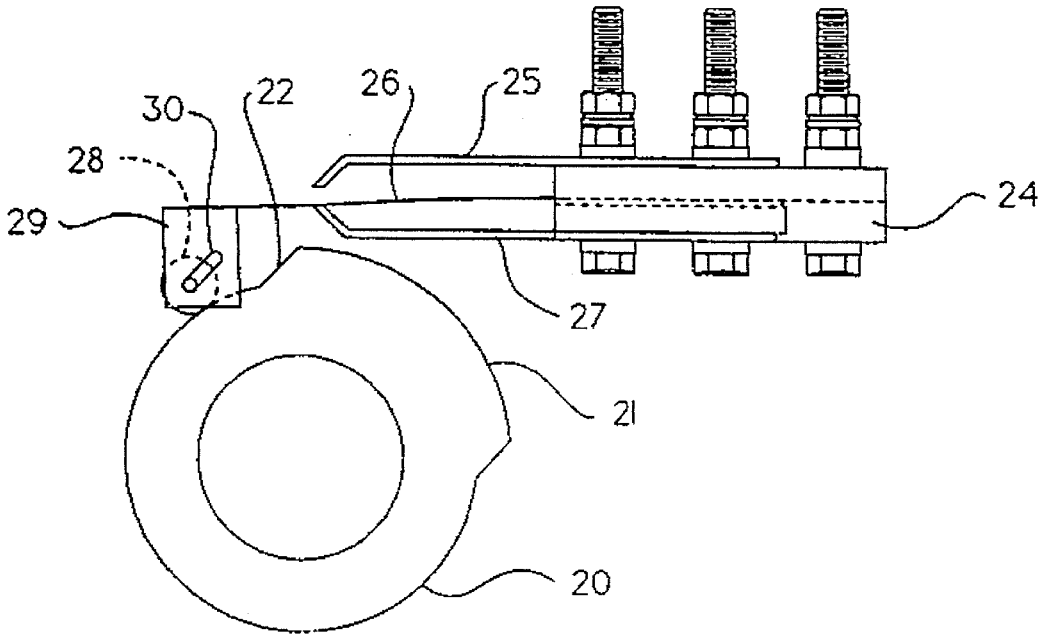
FIG. 4*b* shows an embodiment of the invention similar to FIG. 4*a* after the roller has moved to the inner radius of the cam.

If the cam in FIG. 4*a* is rotated clockwise the roller 28 is caused to roll along the upper surface of cam lobe 21 until it approaches the edge where the slope surface 22 meets the upper surface of the lobe 21. At that time the roller 28 is forced down slope 22, and the axis of the roller 28 translates through slot 30 from the position shown in FIG. 4*a* to a position such as shown in FIG. 4*b*. The result is a cascade effect as the roller 28 moves rapidly along slope 22 by movement within slot 30. This results in the movable contact 26 being quickly moved away from connection with the upper contact 25. The result is that a very small angular movement of cam 20 results in a large displacement of movable contact 26 from upper contact 25. This results in the advantages previously desired, namely, reduced erosion of contacts due to arcing and the reduced likelihood that the contacts will re-close if a minor oscillation or backlash occurs in cam 20.

As seen in FIG. 4*b*, the roller 28 has moved quickly down the slope 22 and also to the opposite extreme of slot 30 from that shown in FIG. 4*a*. This movement within the slot causes the contacts 25 and 26 to part further and creates a hysteresis or dead band in the switch operation. The prior art devices, and specifically viewing FIG. 3*c*, shows a roller which makes and breaks connection between contacts 17 and 18 at the same angular position of lobe 14. If the prior art cam switch such as shown in FIG. 3*c* is stopped precisely at the minimum opening distance, a slight roll bask may cause a re-connection of the circuit. However, because the physical position of the roller 28 has changed from the closed switch position of FIG. 4*a* to the open position shown in FIG. 4*b*, any roll back must not only move the cam 20 back to its initial contact point but must also be of sufficient angular movement such that roller 28 is caused to move to its initial position as shown in FIG. 4*a*. In some embodiments of the invention the angle of the slot 30 relative to the tangent of the outer surface of the cam is chosen such that the roller will not move from its lower slot position as shown in FIG. 4*b* to its upper slot position as shown in FIG. 4*a* until the cam 20 has been moved well past the beginning of lobe 21. The result is that the cam switch of FIG. 4 is such that the switch contacts 25 and 26 are very accurately opened when the cam 20 is rotated in the clockwise position as shown. However, the closure of contacts 25 and 26 upon the return rotation of lobe 20 in the counterclockwise direction does not occur until a position later in the counter-rotational cycle. In the specific preferred application wherein contacts 25 and 26 control the motor current while being powered in the upward direction, such contacts need not be in the active circuit when the arm is being driven downward. Therefore, it is not necessary that contacts 25, 26 close at precisely the same position at which they opened. This specific application utilizes the highly desirable characteristic that minor back-up or roll back through the gearing which may result from backlash or vibrations of the arm do not remake contacts 25 and 26 causing the motor to continue a power up mode even after it has reached its normal up position.

Figure 5A:
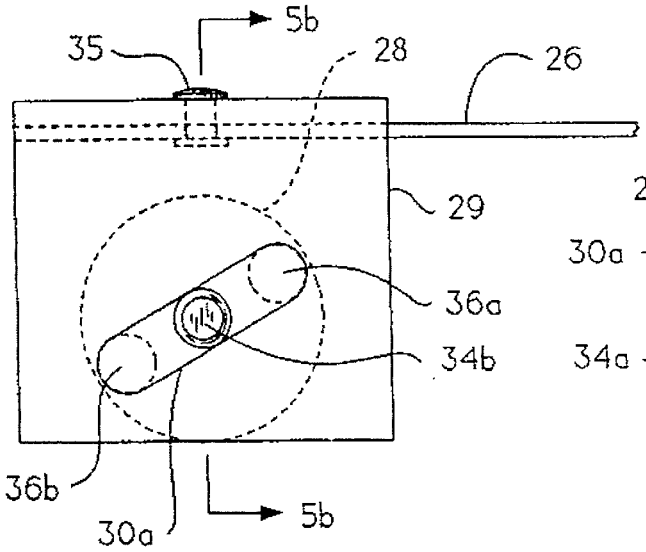
FIGS. 5*a* and 5*b* are diagrams that show details of the bracket and the slot angle on the embodiment of FIG. 4.

FIG. 5*a* shows in more detail the slot 30 in the bracket 29. Bracket 29 can be attached to the movable contact 26 by many means including a rivet 35 as shown. Slot 30*a* can be seen to run at an angle relative to the movable contact 26, the angle of which can be referenced with regard to the lobe and slope on the cam. FIG. 5*a* shows the axle 34*b* in a mid-position within the bracket 29. However, the axle of the roller will usually reside in one of two positions, 36*a* or 36*b*. The first position, 36*a*, corresponds to the roller being on the top of the lobe prior to the switch reaching the slope. 36*b* shows the position of the axle in the slot after the switch, snaps-over, and is in the brake position. Such would occur after the roller has reached the slope area, or on the cam radius.

Figure 5B:
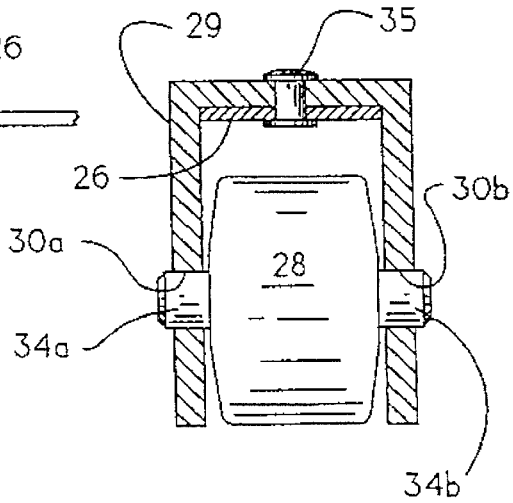

FIG. 5*b* is a cross-section taken of the embodiment shown in FIG. 5*a*. As can be seen there are two slots 30*a* and 30*b*. Similarly, the roller has an axle therethrough which may be integral with the roller 28 or may be a separate shaft or shafts having two end portions 34*a* and 34*b* which respectively engage the slot surfaces of slots 30*a* and 30*b*. The roller size may vary from application to application and various methods of providing a rotational axis to the roller may be used.

Figure 6:
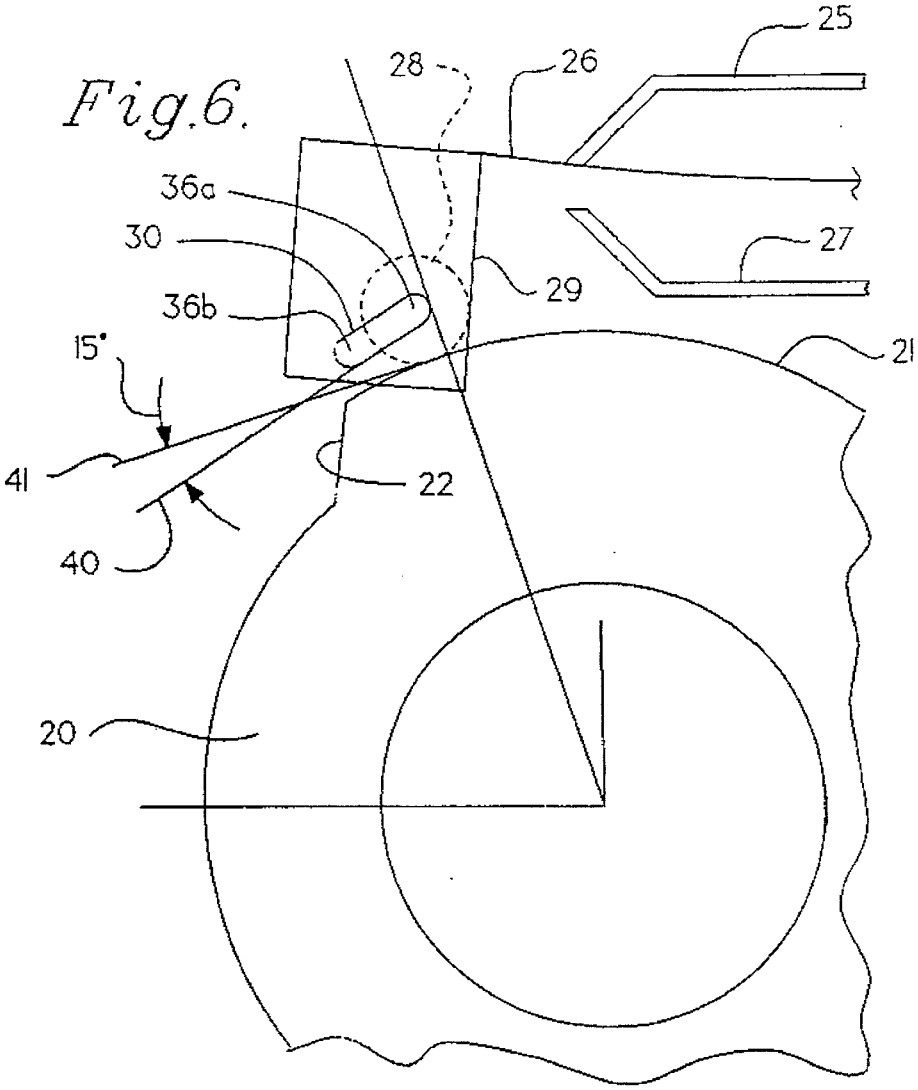
FIG. 6 is a diagrammatic representation showing the angle of the slot in relation to other structure.

FIG. 6 shows a diagrammatic representation similar to those previously discussed, and shows a movable spring contact 26 which has a bracket 29 attached thereto. A slot 30 is shown in the bracket 29. As can be seen, the slot 30 is generally a linear slot. A tangent line 41 is shown which extends tangentially from the surface of the lobe 21. Since the outer lobe surface of 21 and the surface of cam 20 are generally concentric, the tangents of the cam surface and the lobe surface will generally be parallel at any given radial. It is particularly desirable to have the slot 30 intersect the tangent line at an acute angle, less than 45 degrees. This permits a fast translation of the roller 30 from the first to second positions (36*a*, 36*b*, FIG. 5*a*). In the embodiment shown in FIG. 6, the angle of the slot is 15 degrees from the tangent line. As shown, the slot line 40 is drawn parallel to the axis of the slot and/or either side of the slot. Since the slot has generally parallel sides, the line 40 is parallel to the axis and therefore the axis of slot 30 also meets the tangent line 41 at a 15 degree angle. Depending on the slope profile 22 other angles for the slot may be desirable. In some applications an arcuate slot may be preferred.

The slot angle, such as 15°, can produce a fast snap action as well as to provide a tendency to reset the roller. The roller is reset as shown in the position indicated in FIG. 4*a* when the cam is rotated in a clockwise direction before the roller 28 encounters slope 22 again.

It has been shown how the spring tension of a movable contact can be used to force the engagement between a roller on a cam to cause the roller to have a "snap action" and move from a first position to a second position in a slot. As the roller translates from the first position to the second position the movable contact which provides a spring force is moved to make or break a contact with a second contact. The advantages to this type of operation have been shown and described with regard to a highway grade crossing mechanism, and particularly to the drive up contact set of such grade crossing mechanism. However it is to be understood that such slotted roller design cam operated switch can be used in other circuits within a highway crossing mechanism and, in fact, other electrical circuits and devices.

While some embodiments have been shown and described, it will be understood by those skilled in the art that the invention described can be embodied in other devices and other circuits within the scope of the following claims.

We claim:

1. A rotary switch for use in a highway crossing gate mechanism comprising:

a cam adapted to be attached to such mechanism for rotation about a cam axis of such mechanism and said cam having a radius and a lobed portion of a larger radius;

a first switch contact member positioned adjacent said cam for conducting electrical current;

at least one second switch contact member for conducting current selectively from said first switch contact member;

said first switch contact member having a bracket portion attached generally adjacent said cam and said bracket portion includes at least one slot having opposed ends; and a roller having an axle and said roller thereby being rotatably attached to said bracket portion of said first switch contact member for engaging said cam wherein said axle of said roller slidably engages edges of said slot such that said axle of said roller can be at a plurality of positions between said ends of said slot depending upon the position of said roller on said cam.

2. The rotary switch of claim 1 wherein said first switch contact member and said at least one second switch contact member are in electrical connection as said roller is positioned on said lobed portion and said axle of said roller is in a first position; and said first switch contact member and said at least one second switch contact member are not in electrical connection as said roller is positioned on said radius and said axle of said roller is in a second position.

3. The rotary switch of claim 1 wherein said slot is elongated and extends linearly at an angle less than 45 degrees from a line tangent to a surface of said lobed portion adjacent a slope between said cam and said lobed portion.

4. The rotary switch of claim 3 wherein said slot extends at an angle of generally 15 degrees from a line tangent to the surface of said lobed portion adjacent the slope between said cam and said lobed portion.

5. The rotary switch of claim 4 wherein said first electrical switch contact member and said at least one second switch contact member controls the current of a crossing gate arm drive motor;

said cam is mounted on an output shaft of such crossing gate mechanism; and said first switch contact member controls an upward drive of such gate arm.

6. A rotary switch for use with a rotating mechanism comprising:

a cam adapted to be attached to such mechanism for rotation about a cam axis of such mechanism and said cam having a radius and a lobed portion of a larger radius;

a first switch contact member positioned adjacent said cam for conducting electrical current;

at least one second switch contact member for conducting current selectively from said first switch contact member;

said first switch contact member having a bracket portion attached generally adjacent said cam and said bracket portion includes at least one slot having opposed ends; and a roller having an axle and said roller thereby being rotatably attached to said bracket portion of said first switch contact member for engaging said cam wherein said axle of said roller slidably engages edges of said slot such that said axle of said roller can be at a plurality of positions between ends of said slot depending upon the position of said roller on said cam.

7. The rotary switch of claim 6 wherein said first switch contact member and said at least one second switch contact member are in electrical connection as said roller is positioned on said lobed portion and said axle of said roller is in a first position; and said first switch contact member and said at least one second switch contact member are not in electrical connection as said roller is positioned on said radius and said axle of said roller is in a second position.

8. The rotary switch of claim 7 wherein said slot is elongated and extends linearly and at an angle less than 45 degrees from a line tangent to a surface of said lobed portion adjacent a slope between said cam and said lobed portion.

9. The rotary switch of claim 8 wherein said slot extends at an angle of generally 15 degrees from a line tangent to the surface of said lobed portion adjacent the slope between said cam and said lobed portion.

* * * * *